US005697892A

United States Patent [19]

Torgerson

[11] Patent Number: 5,697,892

[45] Date of Patent: Dec. 16, 1997

[54] CONTINUOUS PASSIVE MOTION DEVICE FOR THE HAND AND A METHOD OF USING THE SAME

[75] Inventor: Curt Torgerson, San Diego, Calif.

[73] Assignee: Sutter Corporation, San Diego, Calif.

[21] Appl. No.: 527,732

[22] Filed: Sep. 13, 1995

[51] Int. Cl.[6] ..... A61H 1/00

[52] U.S. Cl. ..... 601/40; 601/5

[58] Field of Search ..... 601/5, 33, 40; 482/44–47, 49

[56] References Cited

U.S. PATENT DOCUMENTS

| | | | |
|---|---|---|---|
| 2,353,129 | 7/1944 | De Mona | 601/40 |
| 3,756,222 | 9/1973 | Ketchum | 601/40 |
| 4,644,938 | 2/1987 | Yates et al. | 601/40 |
| 4,944,758 | 7/1990 | Bekki et al. . | |
| 5,115,806 | 5/1992 | Greuloch et al. | 601/40 |
| 5,178,137 | 1/1993 | Goor et al. | 601/5 |
| 5,303,696 | 4/1994 | Boice | 601/40 |
| 5,326,364 | 7/1994 | Clift, Jr. et al. . | |
| 5,327,882 | 7/1994 | Saringer et al. | 601/40 |

FOREIGN PATENT DOCUMENTS

| | | |
|---|---|---|
| 0350371 | 1/1990 | European Pat. Off. . |
| 2045085 | 10/1980 | United Kingdom . |

OTHER PUBLICATIONS

Anne Hollister et al., *The Axes of Rotation of the Thumb Carpometacarpal Joint*, pp. 454–460, Journal of Orthopaedic Research, vol. 10, No. 3, 1992.

David J. Giurintano and Anne Hollister, *Force Analysis of the Thumb for a Five–Link System*, pp. 213–217, Biomechanics Symposium, vol. 120, 1991.

Paul W. Brand and Anne Hollister, *Clinical Mechanics of the Hand*, Chapter 4, "How Joints Move", pp. 35–59, Mosby Year Book, Second Edition, 1993.

David E. Thompson et al., *A Hand Biomechanics Workstation*, pp. 335–343, Computer Graphics, vol. 22, No. 4, Aug. 1988.

*Primary Examiner*—Jeanne M. Clark

*Attorney, Agent, or Firm*—Quarles & Brady; Thad F. Kryshak; Jennifer B. Wuamett

[57] ABSTRACT

A continuous passive motion device for the hand and its method of use is disclosed. The continuous passive motion hand device includes a base member which is mounted on the hand. The device also includes a rotatable arm mounted on the base member and a rotatable lever mounted on the rotatable arm. A drive bar is fixedly mounted on the rotatable lever and a plurality of linkages connect the drive bar to a respective finger tip. During a cycle of the device, between a full extension and a full flexion of the hand, the drive bar is moved through two hundred and seventy degrees or more by the concerted rotations of the rotatable arm and rotatable lever. Also, during a cycle, each linkage controls and urges the movement of a respective finger tip. Specifically, the end of each linkage that is attached to the drive bar is prevented from rotating about the axis of the guide bar. Additionally, the linkage establishes a second axis for that end of the linkage which is attached to the finger tip. This second axis is maintained substantially parallel to the axis of the guide bar by the linkage, and the linkage also prevents rotation of the finger tip about the second axis to prevent compression and distraction of a finger during a cycle of the device.

18 Claims, 3 Drawing Sheets

CONTINUOUS PASSIVE MOTION DEVICE FOR THE HAND AND A METHOD OF USING THE SAME

FIELD OF THE INVENTION

The present invention pertains generally to physical rehabilitation devices. More particularly, the present invention pertains to devices which rehabilitate a patient through the process of continuous passive motion. The present invention is particularly, but not exclusively, useful as a physical rehabilitation device which involves a continuous passive motion of the hand between a full extension and a full flexion.

BACKGROUND OF THE INVENTION

It is well known that certain injuries to the limbs of the human body can benefit through a rehabilitation program which includes the use of continuous passive motion (CPM) devices. More specifically, it is known that continuous exercise of an affected limb through its respective anatomically correct range of movement will facilitate and accelerate the healing process. Further, these benefits are achievable for many limbs of the body, such as a leg, an arm, or the fingers of a hand. For example, CPM can be beneficial for post-surgical rehabilitation of a crushed hand or for injuries to specific finger joints. Indeed, it is known that CPM can be beneficial for a variety of hand and finger injuries which involve tendons or bones of the hand or finger. Accordingly, several CPM devices have been proposed for this purpose.

In order to best appreciate the function of a CPM hand device, it is necessary to identify the finger movements that are to be affected. For this purpose, reference is made to FIG. 1. In FIG. 1, a hand 10 is shown with a finger 12 in various positions. Specifically, the finger 12' is first shown, in phantom, in a full extension position. The finger 12' is also shown, in phantom, in a full flexion position, i.e. in a fist, and the finger 12' is shown in an intermediate position between full extension and full flexion. For proper CPM it is known that it is necessary to continuously exercise the hand 10, and thus the finger 12, with reciprocal motion between extension and flexion.

The geometry of hand 10 and finger 12 motion for CPM is also shown in FIG. 1. There it will be seen that as the finger 12 moves from extension to flexion, the various bones of the finger 12 will vary in angle relative to the metacarpal bone 14. More specifically, an angle $\psi_1$ is defined between the metacarpal bone 14 and the proximal phalange 16. At the same time an angle $\psi_2$ is defined between the proximal phalange 16 and the middle phalange 18, and an angle $\psi_3$ is defined between the middle phalange 18 and the distal phalange 20. With the finger 12' in full extension, as shown in FIG. 1, the sum $\psi_1+\psi_2+\psi_3$ will equal zero degrees. On the other hand, when a fist is made of the hand 10 finger 12' is in full flexion and the sum of $\psi_1+\psi_2+\psi_3$ will equal approximately two hundred and seventy degrees or more. Further, in properly designing a hand CPM device it is necessary to appreciate that the angles $\psi_1$, $\psi_2$, and $\psi_3$ all vary simultaneously.

By still referring to FIG. 1 it is to be appreciated that, from a purely anatomical point of view, for every particular intermediate position assumed by the finger 12 the sum of the angles $\psi_1$, $\psi_2$, and $\psi_3$ will have, and will maintain, a set specific value. Note, however, that within the sum of $\psi_1+\psi_2+\psi_3$ the individual angles $\psi$ can take different values. Importantly it is the sum of the angles that must remain constant. Moreover, movement of the distal phalange 20 (hereafter sometimes referred to as finger tip 20) can be made in the directions of arrow 22 or arrow 24 without affecting the sum of the angles $\psi_1$, $\psi_2$, and $\psi_3$. Importantly, such movements will not result in compression or distraction of the finger 12. On the other hand, a fixed arc of movement different than the sum of $\psi_1+\psi_2+\psi_3$ of the finger tip 20 in the direction of arrow 26 can result in compression or distraction or both.

As indicated above, several CPM machines have been proposed. For example, a continuous passive motion device for exercising the hand has been previously disclosed in U.S. Pat. No. 4,576,148 which issued to Koerner et al. for an invention entitled "Continuous Passive Motion Hand Device", and which is assigned to the same assignee as the present invention. The Koerner et al. device, is typical of CPM devices for the hand in that a drive bar is provided which forces each finger through a predetermined trajectory. More specifically, these devices include a drive bar or drive rod which is connected directly to the fingers without any intermediate linkage. The result is that the finger tip is forced along the particular trajectory that is traveled by the drive bar. Furthermore, all fingers which are being exercised will be forced to follow similar trajectories. Stated differently, the finger tip is not able to react freely against the drive bar. A consequence of this forced motion is that as the drive bar reciprocates the fingers between full extension and full flexion, each finger can be subjected to either a compression, or a distraction, or an alternating combination of both compression and distraction. Obviously, any compression or distraction of a finger during CPM should be avoided as it may be counterproductive.

In light of the above, it is an object of the present invention to provide a CPM hand device which exercises each finger individually during movement between full extension and full flexion. Another object of the present invention is to provide a CPM hand device which effectively eliminates the possibility of finger compression or distraction during an operational cycle. Still another object of the present invention is to provide a CPM hand device which establishes an end-joint angle for each finger tip which is continuously varied from full extension to full flexion while allowing the finger to continuously float to its natural anatomical position as the finger is curled from full extension into a composite fist. Yet another object of the present invention is to provide a CPM hand device which is relatively easy to manufacture, functionally simple to operate, and comparatively cost effective.

SUMMARY OF THE INVENTION

A physical rehabilitation device to provide continuous passive motion for the hand includes a base member which is mountable on the back of the hand. A fixed arm protrudes from the base member and a rotatable arm is attached for rotation to the protruding end of the fixed arm. Next, a rotatable lever is attached for rotation to the rotatable arm and a gear mechanism which interconnects the fixed arm, the rotatable arm, and the rotatable lever provides for a concerted rotation of both the rotatable arm and the rotatable lever relative to the base member. A drive bar is fixedly attached to the extended end of the rotatable lever.

A flexible linkage interconnects the drive bar of the device with a finger pad which is attachable to a finger tip of the patient. More specifically, the flexible linkage includes a plurality of links which are snapped together and juxtaposed with a pin-in-hole connection between the adjacent links. All of the links have substantially the same dimension and, through the interaction of their pin-in-hole connector with each other, their motion relative to each other is confined to rotation in the same plane.

The flexible linkage further includes an upper cable and a lower cable. Both of these cables each interconnect a first end link with a second end link in the flexible linkage. More specifically, the first and second end links are located at opposite ends of the linkage and the remainder of the links are positioned therebetween. For the flexible linkage, the upper and lower cables are of fixed but unequal length.

In the assembly of the flexible linkage, all of the links are positioned between the upper cable and the lower cable. This construction separates the upper cable from the lower cable by a constant distance that is substantially equal to the height of the individual links. Consequently, due to the fixed length of the upper and lower cables and the confined coplanar movement of the links in the flexible linkage, the first and second end links must necessarily respond to the movement of each other. Importantly, due to the confined coplanar movement of the links, axes that are oriented on the respective end links remain substantially perpendicular to the plane of movement of the links. Stated differently the axes oriented on the respective end links will remain parallel to each other. Further, due to the fixed lengths of the upper and lower cables, neither of the end links can rotate independently about its respective axis.

As indicated above, the flexible linkage interconnects the drive bar of the device with a finger pad which is attachable to a finger tip of the patient. For the attachment to the drive bar, the first end link of the flexible linkage is selectively attached in a fixed relationship with the drive bar. More specifically, an adjustable attachment is mounted on the first end link which is slidable along the drive bar. When the first end link attachment is positioned on the drive bar as desired, further manipulation of the attachment will fixedly hold the first end link in place on the drive bar. For the attachment of the finger pad to a finger tip, the finger pad is first fixedly attached to the second end link of the flexible linkage. Then, an adhesive strap can be used to fixedly hold the finger tip against the finger pad.

It is to be appreciated that a separate flexible linkage can be provided for each finger of the hand. Further, all of the flexible linkages are attached to the same drive bar, but each linkage is connected to only one respective finger tip.

In the operation of the CPM device of the present invention, the base member is mounted on the back of the hand and the flexible linkages are individually attached to the drive bar and to a respective finger tip. The device is then electrically activated to move the rotatable arm and the rotatable linkage. During a complete cycle of the CPM device the drive bar is reciprocated between a first position, wherein the hand is held in full extension, and a second position, wherein the hand is held in full flexion. Specifically, to move the drive bar from one position to the other, the rotatable arm is rotated about the end of the fixed arm through an angle of approximately one hundred and eighty degrees (180°) or more. Simultaneously, the rotatable lever is rotated about the extended end of the rotatable arm through an angle of approximately ninety degrees (90°) or more. Together, these rotations will move the second end link, and consequently the finger tip, through a rotation of approximately two hundred and seventy degrees (270°) or more.

In accordance with the operation of the CPM device, as described above, an end-joint angle is prescribed for the finger tip corresponding to the location of the drive bar in its cyclical movement. Thus, this end-joint angle is continuously varied from full extension to full flexion. It happens, however, that because only the end-joint angle is prescribed, the finger can continuously float to its natural position as the fingers are curled into a composite fist.

BRIEF DESCRIPTION OF THE DRAWINGS

The novel features of this invention, as well as the invention itself, both as to its structure and its operation will be best understood from the accompanying drawings, taken in conjunction with the accompanying description, in which similar reference characters refer to similar parts, and in which.

DESCRIPTION OF THE PREFERRED EMBODIMENTS

Figure 2:
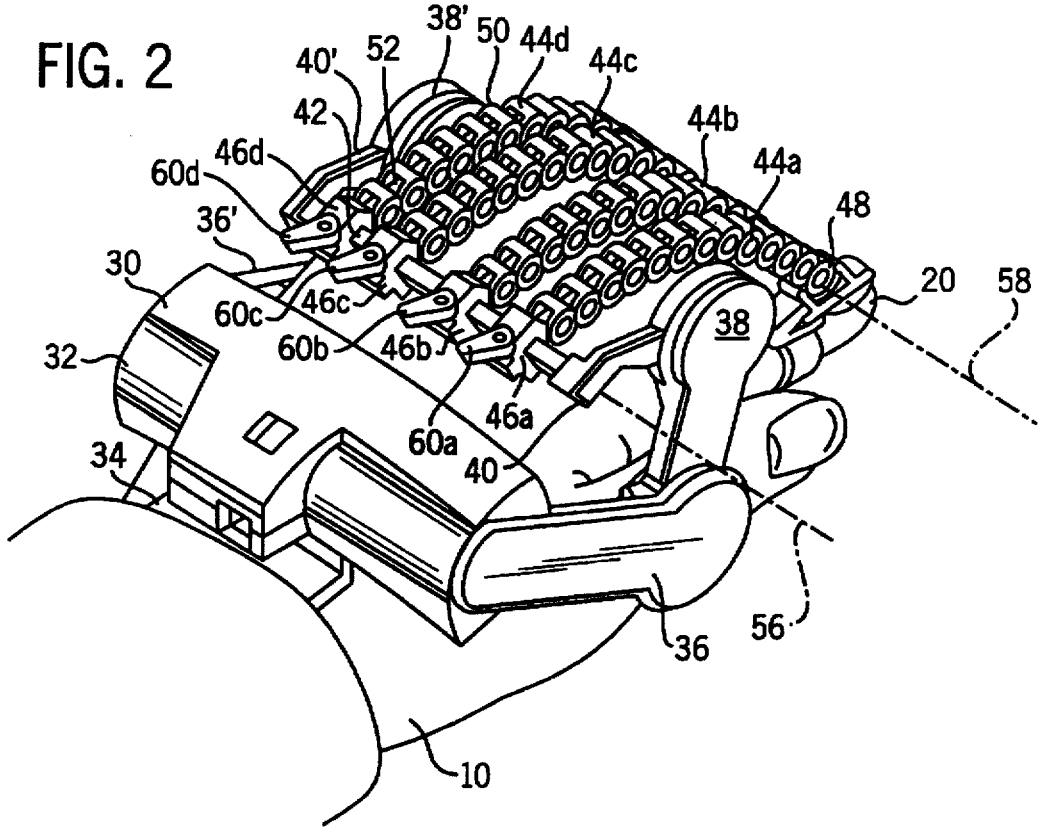
FIG. 2 is a perspective of the device of the present invention shown mounted on a patients's hand with the hand in full extension.

Referring now to FIG. 2, a CPM hand device is shown mounted onto the hand 10 of a patient and is designated 30. As shown, the CPM device 30 includes a base member 32 which is positioned generally on the back of the hand 10, and held there by a support 34. As intended for the present invention, the base member 32 houses a motor (not shown) which can be selectively activated by the user for operation of the device 30. For purposes of the present invention, the motor can be either battery powered or conventionally powered using commercially available electricity. The support 34 can be of any type well known in the pertinent art which is capable of holding the device 30 in a substantially fixed relationship with the hand 10 of the patient.

A fixed arm 36 extends from the base member 32 substantially as shown in FIG. 2, and a rotatable arm 38 extends from the fixed arm 36, also substantially as shown. Additionally, a rotatable lever 40 extends from the rotatable arm 38, and a drive bar 42 extends from the rotatable lever 40. More specifically, drive bar 42 is fixedly mounted on rotatable lever 40 and extends from the rotatable lever 40 in a direction that is substantially perpendicular to the plane of rotation of the rotatable lever 40 and the rotatable arm 38. Although only partially shown in FIG. 2, the device 30 of the present invention preferably has an additional fixed bar 36', an additional rotatable arm 38' and an additional rotatable lever 40' which act opposite and in parallel to the above disclosed elements. Only one set of these elements, however, is discussed here.

FIG. 2 also shows that device 30 includes at least one, and possibly four, substantially similar flexible linkages **44*a–d***.

Flexible linkage 44*a* is exemplary and is shown to include an end link 46 which is mounted on the drive bar 42. Flexible linkage 44*a* also has an end link 48 which is attached to the patient's finger tip 20. Between end link 46 and end link 48 are a plurality of intermediate links 50 which are all substantially similar in their construction.

For proper operation of the device 30 of the present invention, the intermediate links 50 and the end links 46, 48 must interact with each other in a predetermined and predictable manner. Specifically, the relative rotations of the links 50 with respect to other links in flexible linkage 44 must all be in the substantially the same plane. A specific structure for the links 50 which will accomplish this is discussed below with reference to FIGS. 5, 6 and 7.

In addition to confining the rotations of the intermediate links 50 to a same plane, the end links 46 and 48 also have movement limitations. Specifically, the end links 46 and 48 are prevented from independently rotating about respective axes perpendicular to the rotational plane of the intermediate links 50. To accomplish this, each flexible linkage 44*a–d* of the device 30 further includes an upper cable 52 and a lower cable 54. One end of the cable 52 is fixedly attached to end link 46 and the other end of the cable 52 is fixedly attached to end link 48. Similarly, one end of the cable 54 is fixedly attached to end link 46 and the other end of the cable 54 is fixedly attached to end link 48. As perhaps best appreciated by reference to FIG. 6, the cables 52 and 54 are not fixedly attached to the intermediate links. Instead, the cables 52 and 54 are respectively threaded through the intermediate links 50. Although upper cable 52 is longer in length than is lower cable 54, the links 46, 48 and 50 are dimensioned so that, throughout the length of the flexible linkage 44, the upper cable 52 is maintained at an approximately constant distance from the lower cable 54.

Figure 1:
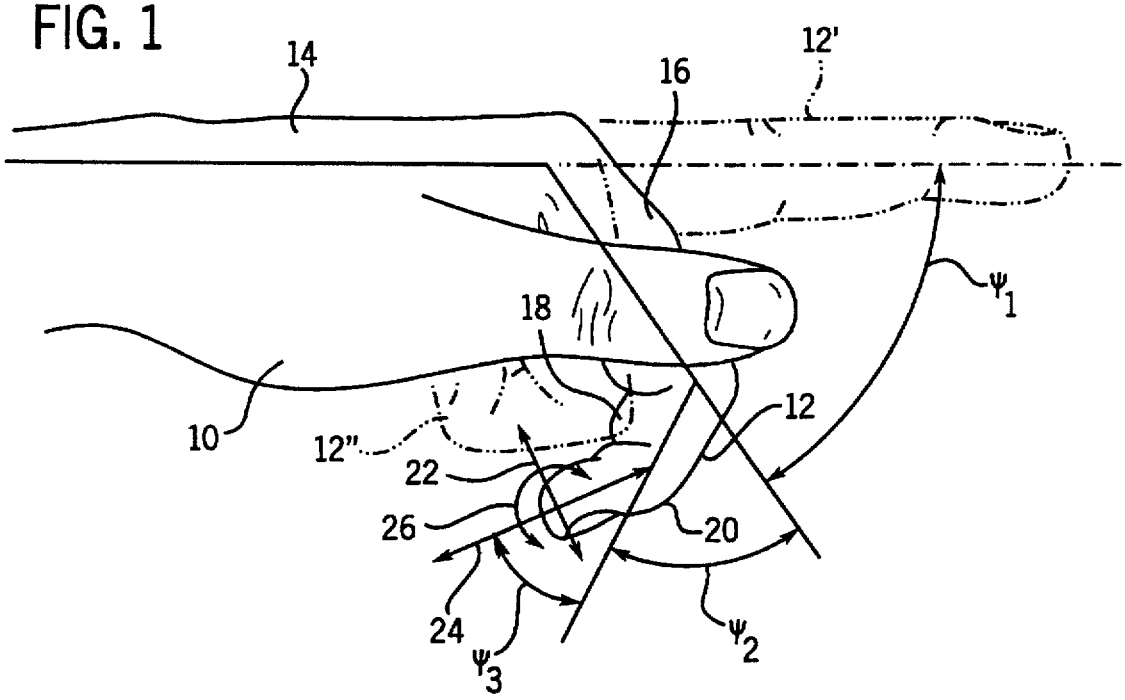
FIG. 1 is a side elevational view of a hand showing the fingers of the hand in a position between full extension (shown in phantom) and full flexion (shown in phantom)

As implied above, a consequence of the construction disclosed above for flexible linkage 44 is that the axis 56 defined by drive bar 42, and thus end link 46 which is fixedly attached thereto, will remain substantially parallel to the axis 58 that is defined by the end link 48. Furthermore, and importantly, relative to any set position for axis 56 there can be no rotation of the end link 48 about axis 58. This is so even though the axis 58 can be moved in parallel relative to axis 56. Anatomically, this constrained relative movement between end link 46 and end link 48 is very significant. Referring for the moment back to FIG. 1, it will be appreciated that, for the device 30 of the present invention, end link 48 can move in the directions of both arrows 22 and 24 but will not rotate in the direction of arrow 26. This is anatomically correct.

Still referring to FIG. 2, it will be seen that the end links 46*a–d* each include a friction based attachment 60*a–d* which can be moved to selectively clamp end link 46 onto drive bar 42. Thus, each individual end link 46 can slide along drive bar 42 until it is appropriately positioned on the drive bar 42. When so positioned, attachment 60*a–d* can be manipulated to fixedly hold the end link 46*a–d* on drive bar 42. The particular mechanism for selectively clamping end links 46*a–d* onto drive bar 42 can be of any type well known in the art.

Figure 3:
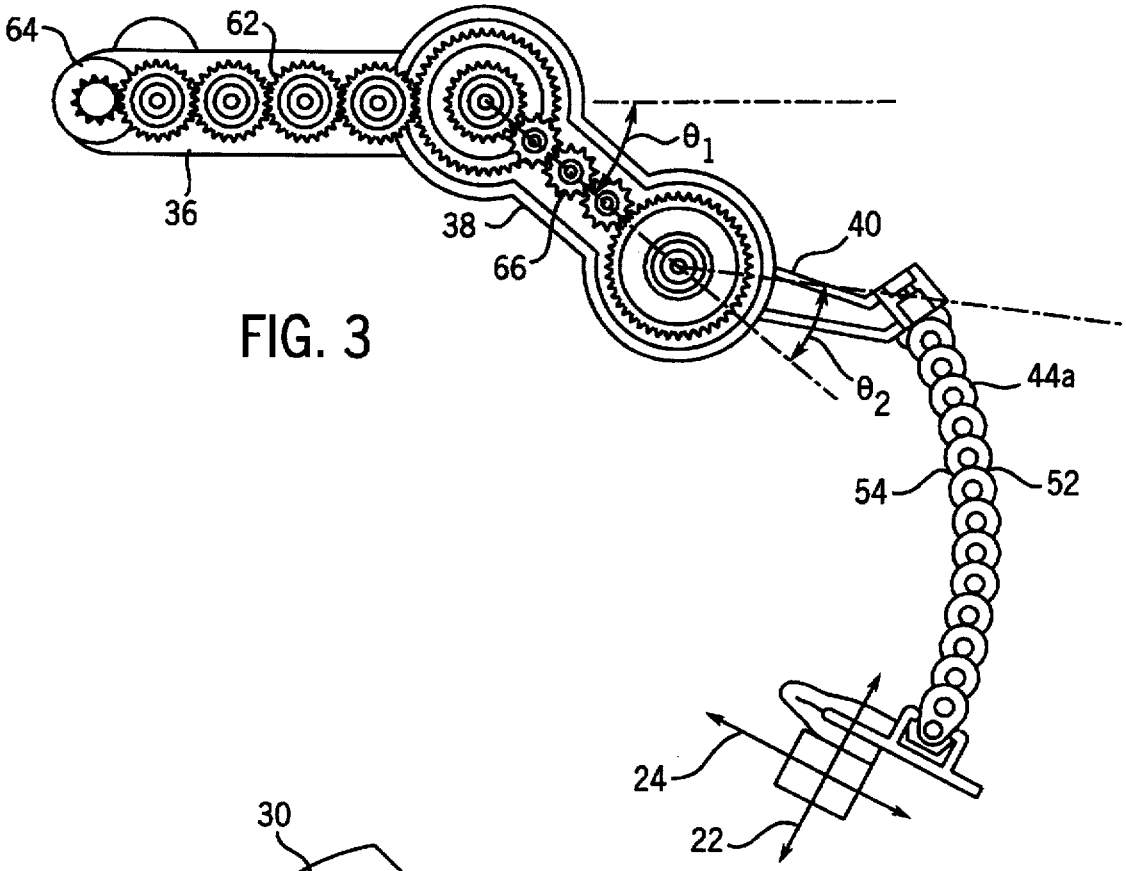
FIG. 3 is an exposed view of the gear train of the device of the present invention with the device in an intermediate orientation between extension and flexion.

Referring now to FIG. 3 it will be seen that a gear train 62 is mounted in fixed arm 36. Specifically, the gear train 62 includes a drive gear 64 which is rotated by the motor (not shown) of device 30. In accordance with standard gearing operations, the rotation of drive gear 64 and the consequent rotation of gears in the gear train 62 will cause rotatable arm 38 to rotate through an angle $\theta_1$. As indicated in FIG. 3, $\theta_1$ is the angle between the longitudinal axis of fixed arm 36 and the longitudinal axis of rotatable arm 38.

As also shown in FIG. 3, the rotatable arm 38 includes a gear train 66 which is operatively connected to the gear train 62. Consequently, a rotation of gears in gear train 62 causes the gears in gear train 66 to also rotate. Then, through the action of gear train 66, rotatable lever 40 is rotated through an angle $\theta_2$. As indicted in FIG. 3, $\theta_2$ is the angle between the longitudinal axis of rotatable arm 38 and an axis generally oriented along the longitudinal direction of rotatable lever 40.

Figure 4:
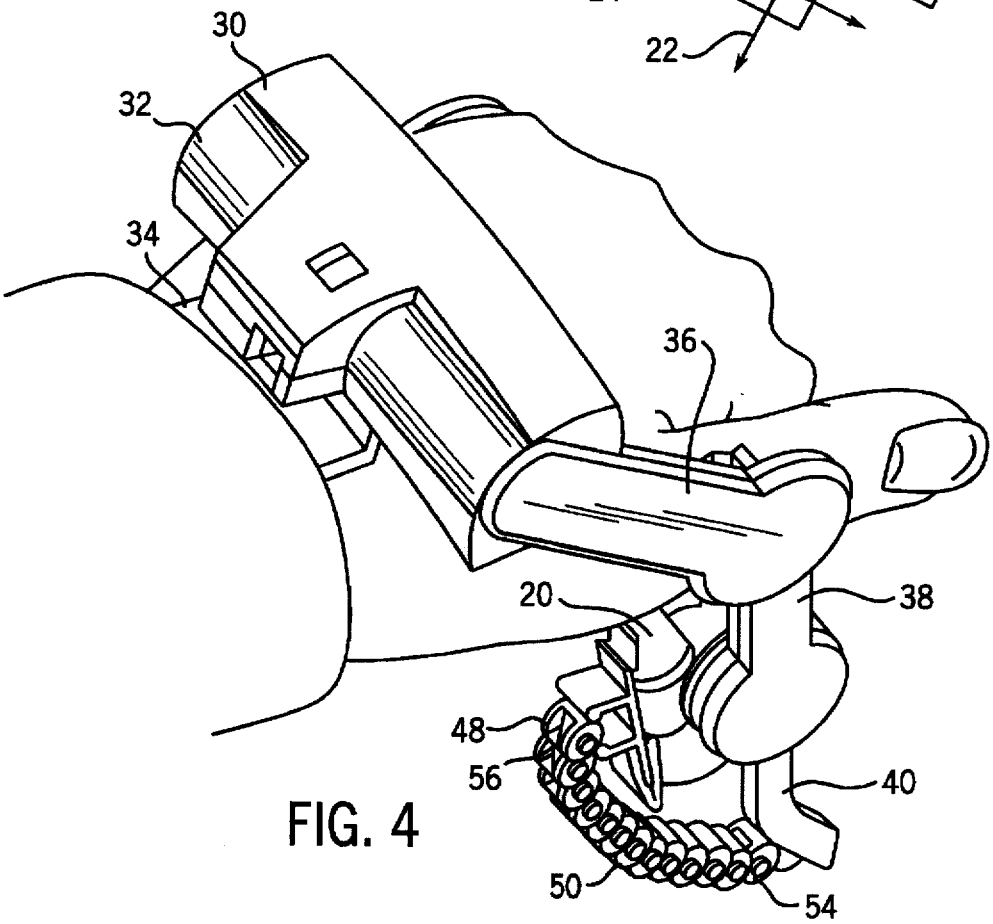
FIG. 4 is a perspective of the device of the present invention shown mounted on a patients's hand with the hand in full flexion.

For the present invention, the total change in the sum of the angles $\theta_1+\theta_2$ during a cycle of device 30 will equal approximately two hundred and seventy degrees (270°). Of this total change, angle $\theta_1$ will change approximately one hundred and eighty degrees (180°) and angle $\theta_2$ will change approximately ninety degrees (90°). It will be appreciated by the skilled artisan that the collective and individual changes in angles $\theta_1$ and $\theta_2$ will be dependent on the gear ratios which are engineered between individual gears in gear train 62 and gear train 66. In any case, the intended result during each cycle of the device 30 is that the fingers 12 of hand 10 are exercised between a full extension configuration as shown in FIGS. 1 and 2, and a full flexion configuration as shown in FIGS. 1 and 4. This requires a combined change in angles $\theta_1$ and $\theta_2$ which is equal to approximately two hundred and seventy degrees (270°).

Figure 5:
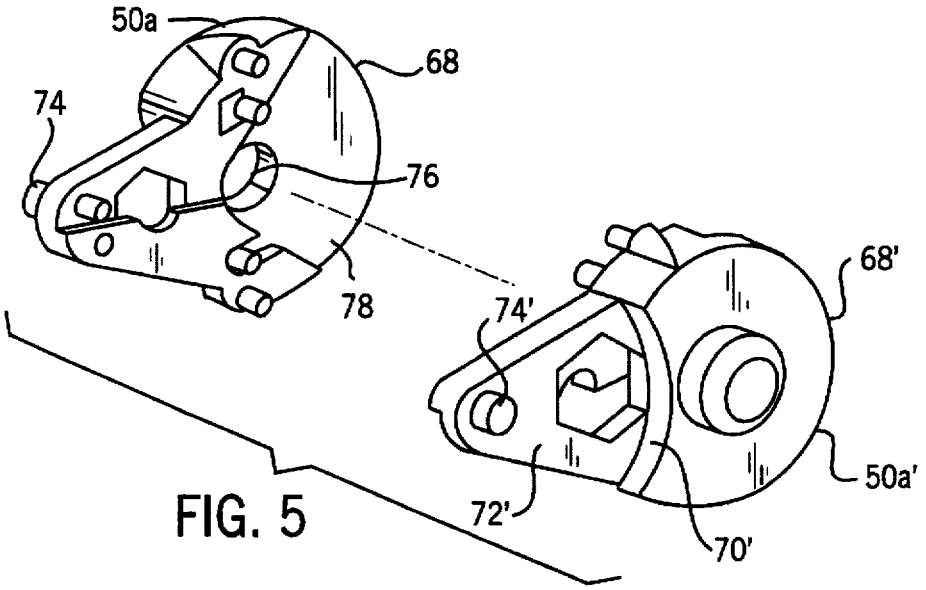
FIG. 5 is an exploded view of an individual link from the flexible linkage of the present invention.

Turning now to FIG. 5, it will be seen that each link 50 in a linkage 44 of device 30 includes mating halves. For purposes of disclosure, one half of any particular link is referenced with the numeral 50, and the other mating half of the link 50 is referenced with the numeral 50'. As shown, each half of a link 50 is formed with an arcuate convex surface 68 and with an arcuate concave surface 70. Also, each half of a link 50 is formed with an extension 72 which has a pin 74 extending therefrom in a direction substantially perpendicular thereto. As perhaps best seen with reference to the half link 50*a* in FIG. 5, each half of a link 50 includes a hole 76 and recess 78 which surrounds the hole 76.

Figure 6:
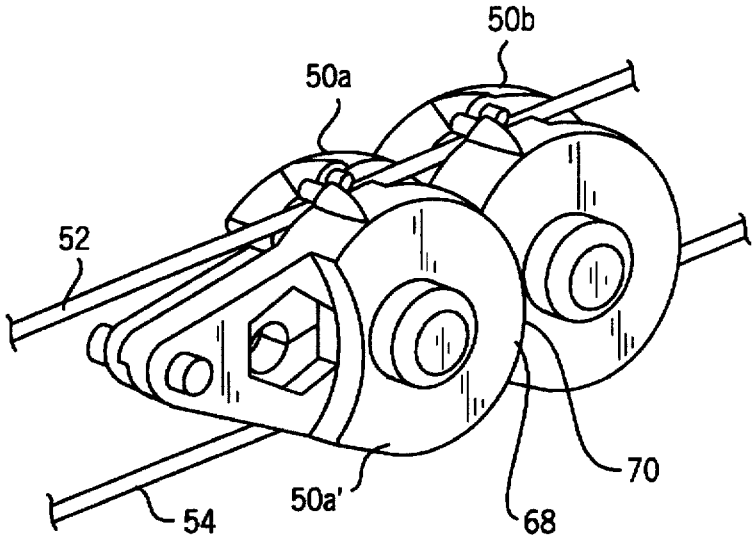
FIG. 6 is a perspective view of a portion of the flexible linkage showing the interaction between individual links and the upper and lower cables.

When half link 50*a* is snapped together, or glued together, with half link 50*a'* as shown in FIG. 6 it also needs to be joined with other links 50 in the linkage 44, such as link 50*b*. Specifically, it will be seen in FIG. 6 that when adjacent links 50 (e.g. 50*a* and 50*b*) are joined together, the arcuate convex surface 68 of the link 50*a* is placed in a mating and sliding relationship with the arcuate concave surface 70 of the link 50*b*. Further, it is to be appreciated that the when so joined, the pins 74 of link 50*b* are seated in the holes 76 of link 76. This interconnection also places the extension 72 of link 50*b* in the angled recess 78 of link 50*a*. Then, because the angle of recess 78 of link 50*a* is greater in its sweep than is the dimensioned width of extension 72 of link 50*b*, some relative motion between the two links 50*a* and 50*b* is allowed. More specifically, within a defined plane there can be relative rotation between the links 50*a* and 50*b*.

Figure 7:
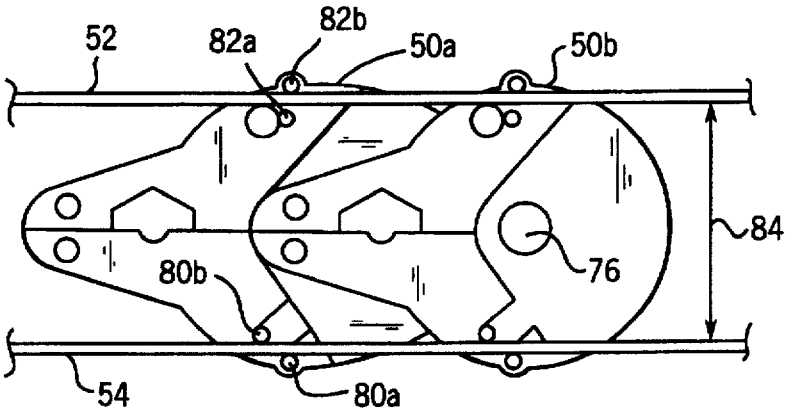
FIG. 7 is an exposed view of individual links from the flexible linkage showing their interaction with the upper and lower cables.

FIG. 7 shows that each half link 50 and 50' includes a pair of protrusions 80*a–b* which are formed on the half link and are located substantially opposite the hole 76 from another pair of protrusions 82*a–b*. It happens that when the half links 50 and 50' are joined together, these protrusions 80*a–b* and 82*a–b* form respective channels for holding the cables 52 and 54. Importantly, the cables 52 and 54 are held by the protrusion 80 and 82 at a constant distance 84 from each other throughout the entire length of the cables 52, 54. This is so even though, as indicated above, the cables 52 and 54 are of different lengths. Also importantly, the support which is provided by the links 50 for cables 52 and 54 does not interfere with the relative rotational motion between the links 50 of flexible linkage 44.

While the particular hand CPM as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A continuous passive motion hand device which comprises:

a drive bar;

a flexible linkage having a first end link defining a first axis and a second end link defining a second axis, said first end link being adjustably attached to said drive bar;

a control assembly interconnecting said first end link with said second end link to maintain said first axis substantially parallel with said second axis and to prevent rotation of said second axis about said first axis;

means attachable to said second end link for securely holding a finger tip to said second end link; and moving means mountable on the hand for reciprocally moving said drive bar along a predetermined path to exercise the hand and finger, said moving means comprising a base member; a fixed arm extending from said base, said fixed arm having an end distanced from said base member; a rotatable arm having a first end and a second end, said first end of said rotatable arm being mounted for rotation on said end of said fixed arm; and a rotatable lever having a first end and a second end, said first end of said rotatable lever being mounted for rotation on said second end of said rotatable arm, and said drive bar being fixedly mounted on said second end of said rotatable lever.

2. A device as recited in claim 1 wherein said moving means has a range of motion capable of achieving full extension and full flexion of the hand.

3. A device as recited in claim 1 wherein during a movement of said drive bar between a first position corresponding to full extension of the hand and a second position corresponding to full flexion of the hand, said rotatable arm rotates about an end of said fixed arm through a first angle and said rotatable lever rotates about an end of said rotatable arm through a second angle.

4. A device as recited in claim 3 wherein a total value for said first angle and said second angle equals an angle having a value in the range of from zero to two hundred and seventy degrees with said first position of said drive bar corresponding to an angle having a value of zero degrees and said second position of said drive bar corresponding to an angle having a value of two hundred and seventy degrees.

5. A device as recited in claim 1 wherein said flexible linkage comprises a plurality of intermediate links, said intermediate links being positioned between said first end link and said second end link and sequentially juxtaposed with adjacent said links.

6. A device as recited in claim 5 wherein said first end link, said second end link, and said plurality of intermediate links are each formed with at least one hole and one pin and each said pin interacts with said hole of an adjacent said link to confine the relative motion between all said links to substantially the same plane.

7. A device as recited in claim 5 wherein said control assembly comprises:

a first cable having a fixed length, said first cable interconnecting said first end link with said second end link;

a second cable having a fixed length, said second cable interconnecting said first end link with said second end link; and means for maintaining a predetermined distance between said first cable and said second cable.

8. A device as recited in claim 7 wherein said first cable and said second cable surround said plurality of intermediate links.

9. A device as recited in claim 1 further comprising a plurality of said flexible linkages.

10. A device as recited in claim 9 wherein said first end link of each said flexible linkage includes means for attaching said first end link to said drive bar, said attaching means being slidably disposed on said drive bar to selectively position said first end link thereon.

11. A continuous passive motion hand device which comprises:

a drive bar;

means for rotating said drive bar along a predetermined path between a first position and a second position, said rotating means being mountable on the hand;

means for urging movement of a finger tip in response to a movement of said drive bar, said urging means having a first end defining a first axis and a second end defining a second axis, said first end being slidably attached to said drive bar and said second end being attachable to a finger tip;

means for maintaining said first axis substantially parallel with said second axis; and means for preventing rotation of said second axis about said first axis;

wherein said rotating means comprises:

a base member;

a fixed arm extending from said base member, said fixed arm having an end distanced from said base member;

a rotatable arm having a first end and a second end, said first end of said rotatable arm being mounted for rotation on said end of said fixed arm; and a rotatable lever having a first end and a second end, said first end of said rotatable lever being mounted for rotation on said second end of said rotatable arm, and said drive bar being fixedly mounted on said second end of said rotatable lever.

12. A device as recited in claim 11 wherein during a movement of said drive bar between said first position and said second position, said rotatable arm rotates about an end of said fixed arm through a first angle and said rotatable lever rotates about said second end of said rotatable arm through a second angle with a total value for said first angle and said second angle equaling an angle having a value in the range of from approximately zero to two hundred and seventy degrees with said first position of said drive bar corresponding with an angle to establish a full extension of the hand and said second position of said drive bar corresponding with an angle to establish a full flexion of the hand.

13. A device as recited in claim 12 wherein said urging means further comprises a plurality of intermediate links, said intermediate links being positioned between said first end and said second end and sequentially juxtaposed therebetween, and wherein said first end, said second end, and said plurality of intermediate links are each formed with at least one hole and one pin and each said pin interacts with said hole of an adjacent said link to confine the relative motion between all said links to substantially the same plane.

14. A device as recited in claim 13 wherein said maintaining means is a control assembly which comprises:

a first cable interconnecting said first end with said second end;

a second cable interconnecting said first end with said second end; and means for maintaining a predetermined distance between said first cable and said second cable.

15. A device as recited in claim 14 wherein said first cable and said second cable surround said plurality of intermediate links.

16. A device as recited in claim 15 further comprising a plurality of said urging means and wherein said first end of each said urging means includes means for attaching said first end to said drive bar, said attaching means being slidably disposed on said drive to selectively position said first end of each said urging means thereon.

17. A method for exercising the hand with continuous passive motion which comprises the steps of:

mounting a drive unit on the hand, said drive unit comprising a base member, a fixed arm extending from said base, a rotatable arm having a first end and a second end with said first end of said rotatable arm being mounted for rotation on said fixed arm, a rotatable lever having a first end and a second end, said first end of said rotatable lever being mounted for rotation on said second end of said rotatable arm, and a drive bar fixedly mounted on said second end of said rotatable lever;

attaching a flexible linkage to said drive bar, said flexible linkage comprising a flexible linkage having a first end link defining a first axis and a second end link defining a second axis, said first end link being attached to said drive bar to prevent rotation of said first end link about said first axis;

providing a control assembly for said flexible linkage, said control assembly interconnecting said first end link with said second end link to maintain said first axis substantially parallel with said second axis and to prevent rotation of said second end link about said second axis;

attaching a finger pad to said second end link for securely holding a finger tip on said second end link; and activating said drive unit to move said drive bar along a predetermined path between a first position wherein said finger pads are located to place the hand in full extension and a second position wherein said finger pads are located to place the hand in full flexion.

18. A method as recited in claim 17 further comprising the step of reciprocally moving said drive bar along said predetermined path to exercise the hand and finger.

* * * * *